US008484851B2

(12) United States Patent
Buchan

(10) Patent No.: US 8,484,851 B2
(45) Date of Patent: Jul. 16, 2013

(54) HAIR FEATHERING RAZOR

(76) Inventor: Joseph Eugene Buchan, Charlotte, NC (US)

( * ) Notice: Subject to any disclaimer, the term of this patent is extended or adjusted under 35 U.S.C. 154(b) by 0 days.

(21) Appl. No.: 13/193,742

(22) Filed: Jul. 29, 2011

(65) Prior Publication Data

US 2012/0047748 A1 Mar. 1, 2012

Related U.S. Application Data

(60) Provisional application No. 61/377,258, filed on Aug. 26, 2010.

(51) Int. Cl.
*B26B 21/00* (2006.01)
*B26B 17/00* (2006.01)

(52) U.S. Cl.
USPC ..... 30/32; 30/34.05; 30/53; 30/182

(58) Field of Classification Search
USPC ..... 30/32, 34.05, 53, 238, 241–243, 30/182–185, 94; 32/200, 224; 219/225; D8/98; 132/200, 224
See application file for complete search history.

(56) References Cited

U.S. PATENT DOCUMENTS

| | | | | | |
|---|---|---|---|---|---|
| 271,250 | A | * | 1/1883 | Kinney | 30/94 |
| 888,297 | A | * | 5/1908 | Bell | 30/363 |
| 1,455,696 | A | * | 5/1923 | Wright | 132/224 |
| 2,686,362 | A | * | 8/1954 | Dancey | 30/182 |
| 2,869,413 | A | * | 1/1959 | Anderson | 30/94 |
| 3,054,182 | A | * | 9/1962 | Whitton, Jr. | 30/179 |
| 3,755,894 | A | * | 9/1973 | Burdick | 30/181 |
| 3,772,783 | A | * | 11/1973 | Averitt | 30/260 |
| 3,883,953 | A | * | 5/1975 | Saullo et al. | 30/304 |
| 3,938,412 | A | * | 2/1976 | Ushkow | 30/94 |
| 4,394,796 | A | * | 7/1983 | Winer | 30/178 |
| 4,972,583 | A | * | 11/1990 | Pinchon | 30/90.6 |
| 5,036,590 | A | * | 8/1991 | Reinke et al. | 30/261 |
| 5,054,699 | A | * | 10/1991 | DeJaynes | D8/98 |
| 5,072,515 | A | * | 12/1991 | Heitz | 30/304 |
| D326,215 | S | * | 5/1992 | DeJaynes | D8/98 |
| D331,530 | S | * | 12/1992 | Metzner | D8/98 |
| 5,206,996 | A | * | 5/1993 | McDaniel | 30/101 |
| 5,475,924 | A | * | 12/1995 | McDaniel | 30/102 |
| D387,965 | S | * | 12/1997 | Ronan | D8/98 |
| 5,884,402 | A | * | 3/1999 | Talavera | 30/30 |
| 5,964,033 | A | * | 10/1999 | Wolf | 30/175 |
| 6,191,387 | B1 | * | 2/2001 | Smal | 219/225 |
| 6,581,809 | B1 | * | 6/2003 | McElhinney | 223/51 |
| 6,588,108 | B2 | * | 7/2003 | Talavera | 30/30 |
| 6,883,237 | B2 | * | 4/2005 | Klatt et al. | 30/30 |
| 7,007,388 | B2 | * | 3/2006 | Wan | 30/30 |
| 7,040,021 | B2 | * | 5/2006 | Talavera | 30/30 |
| 7,275,320 | B2 | * | 10/2007 | Lee | 30/101 |
| 2003/0159295 | A1 | * | 8/2003 | Tapia | 30/175 |
| 2003/0159296 | A1 | * | 8/2003 | Tapia | 30/175 |

* cited by examiner

*Primary Examiner* — Jason Daniel Prone
(74) *Attorney, Agent, or Firm* — Shumaker, Loop & Kendrick, LLP

(57) ABSTRACT

A hair feathering razor including first and second interconnected handles that move between open and closed positions, a biasing element tending to open the handles, a razor blade extending outwardly from the first handle, and a hair guiding bar extending outwardly from the second handle, wherein the hair guiding bar and the razor blade are in parallel alignment and move toward one another in the closed position. The hair feathering razor can further include a roller rotatably carried on the hair guiding bar.

9 Claims, 4 Drawing Sheets

HAIR FEATHERING RAZOR

CROSS-REFERENCE TO RELATED APPLICATION

This non-provisional application claims priority to U.S. Provisional Application No. 61/377,258 filed Aug. 26, 2010, the contents of which are incorporated by reference herein.

TECHNICAL FIELD AND BACKGROUND

The exemplary embodiments provided herein relate to a specialized type of razor for use by hair stylists and barbers to create various hairstyles requiring feathering, layering or blending hair, and is particularly useful when cutting hair that is dense or coarse. When done properly, these techniques can reduce hair density and volume, while at the same time shaping the hair so that it lies properly on the head. These techniques typically involve the use of a comb in one hand and a straight razor in the other, with considerable training and experience required to safely and rapidly move the comb and razor in the correct manner necessary to achieve the correct results. The comb, for example, can be used to raise and expose a thin, elongate section of hair, and the razor, for example, can be drawn obliquely across the section of hair, cutting each hair at a slightly different angle and location so that the hair is not all cut to the same length. Hence, "layering", "feathering" or "blending" the hair.

Provided herein are exemplary embodiments of a device that permits these techniques to be practiced easily and safely. In an exemplary method of use, the device can be held in one hand and used in conjunction with a conventional barber comb held in the other. The device is simple and safe to use, and is easy to clean and maintain, among other advantages.

BRIEF SUMMARY

In one embodiment, a hair feathering razor includes first and second handles connected together and configured to be move between open and closed positions, a biasing element tending to open the first and second handles, an elongate razor blade extending outwardly from the first handle; and an elongate hair guiding bar extending outwardly from the second handle, In this embodiment, the hair guiding bar and the razor blade are aligned parallel to one another such that the hair guiding bar and the razor blade are together, but not necessarily engaged, when the handles are in the closed position, and apart when the handles are in the open position.

In a further aspect, the hair feathering razor includes a roller rotatably carried on the hair guiding bar, wherein the razor blade and the roller are in parallel alignment and have substantially the same length.

In a further aspect, the hair feathering razor includes a variable spacer for spacing the razor blade and the hair guiding bar apart in the closed position.

In a further aspect, the razor blade engages the hair guiding bar in the closed position.

In a further aspect, the first and second handles are interconnected through at least one guide rod, and preferably spaced-apart guide rods, that maintains the first and second handles parallel to one another as the handles are moved between the open and closed positions.

In a further aspect, the first handle is fixed relative to the at least one guide rods and the second handle is slidable along the at least one guide rod.

In a further aspect, the biasing element is a spring positioned between the first and second handles for biasing the first and second handles toward the open position.

In a further aspect, the razor blade is arranged substantially perpendicular to the hair guiding bar.

In a further aspect, the razor blade is arranged at an angle relative to the hair guiding bar.

In a further aspect, the razor blade is removably secured within a razor blade holder extending outwardly from the second handle.

In a further aspect, the first and second handles are pivotably connected.

In another embodiment, a hair feathering razor is provided herein including first and second handles connected together and configured to be manually gripped and moved between open and closed positions, the second handle having at least one guide rod extending therefrom upon which the first handles slides, a biasing element tending to bias the first and second handles toward the open position, an elongate razor blade extending outwardly from the first handle, and an elongate hair guiding bar extending outwardly from the second handle. In this embodiment, the hair guiding bar and the razor blade move toward one another in the closed position and apart in the open position.

In a further aspect, the hair feathering razor includes a variable spacer for spacing the razor blade and the hair guiding bar apart in the closed position such that the razor blade can engage or is prevented from engaging the guiding bar in the closed position.

In a further embodiment, a method of cutting hair is provided herein including providing a hair feathering razor including first and second handles connected together and moveable between open and closed positions, a biasing element tending to open the first and second handles, an elongate razor blade extending outwardly from the first handle, and an elongate hair guiding bar extending outwardly from the second handle. The hair guiding bar and the razor blade are in parallel alignment such that the hair guiding bar and the razor blade are together, but not necessarily engaged, when the handles are in the closed position, and apart when the handles are in the open position. The method further includes passing a comb through the hair to expose a section of hair through the comb, manipulating the section of hair held in place by the comb into a space between the razor blade and the roller, moving the handles toward each other, and pulling the razor towards the ends of the hairs to cut the hair using the surface of the comb as a support and guide.

BRIEF DESCRIPTION OF THE DRAWINGS

Although some of the features, aspects and advantages of the exemplary embodiments have been set forth above, other features, aspects and advantages will appear as the description of the exemplary embodiments proceeds when taken in conjunction with the following drawings, in which.

DESCRIPTION OF THE PREFERRED EMBODIMENTS AND BEST MODE

Figure 1:
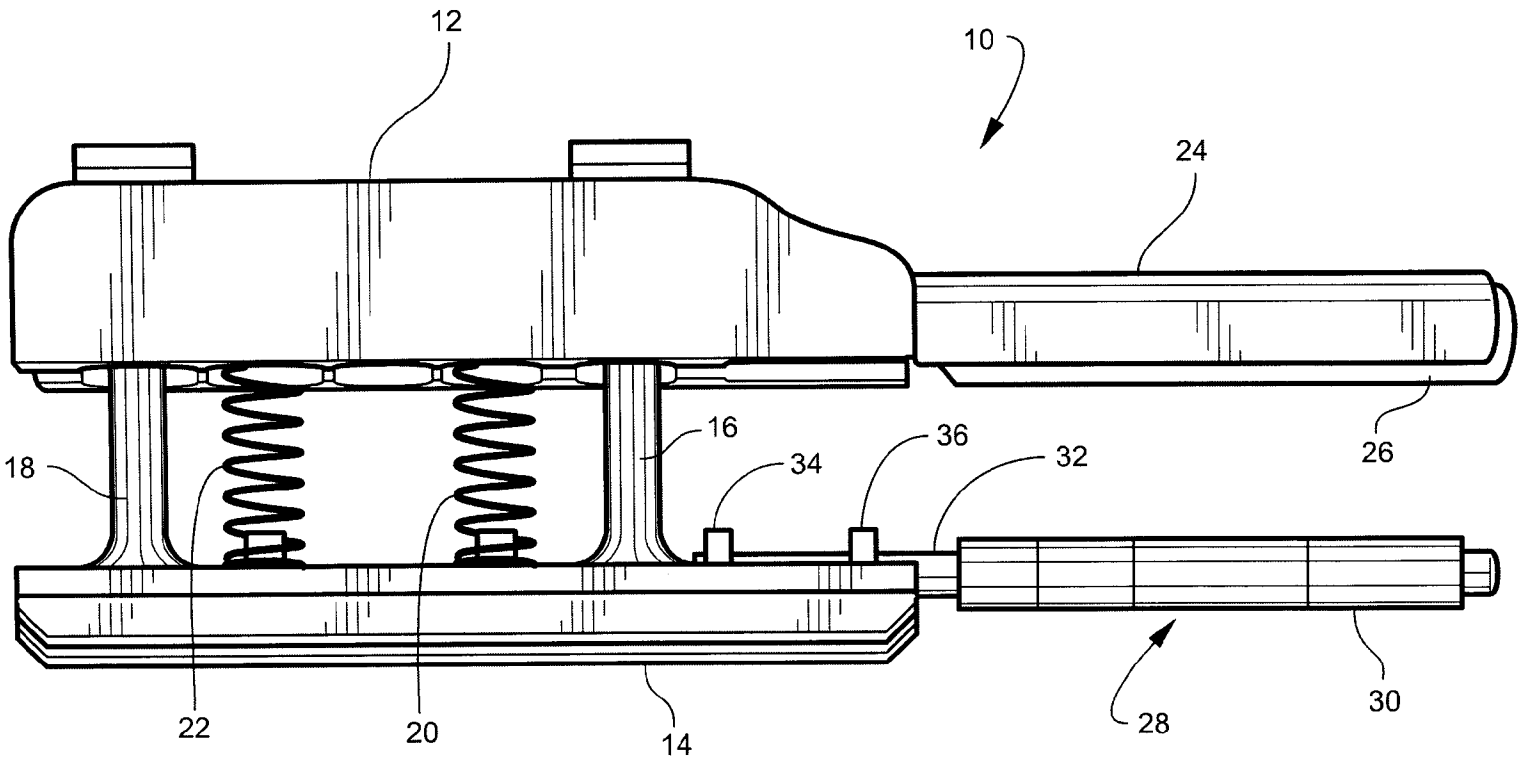
FIG. 1 is a side elevation of a hair feathering razor according to an exemplary embodiment.

Referring now specifically to the drawings, a hair feathering razor is shown generally in FIG. 1 at reference numeral 10. Razor 10 includes first and second opposed handles 12, 14 configured to be manually gripped and moved between an open position in which the handles are apart (see FIG. 3), and a closed position in which the handles are substantially together (see FIG. 4). As shown, the handles 12, 14 are configured for sliding movement along spaced-apart guide rods 16, 18 that maintain the handles in parallel alignment and prevent rotation therebetween. In a specific embodiment, the guide rods 16, 18 are fixed to the second handle 14, and the first handle 12 slides along the guide rods.

At least one biasing element, for example coil springs 20, 22, maintain the handles 12, 14 biased in a normally open position. The biasing element provides resistance, and thus control, as the handles 12, 14 are compressed toward one another and move apart when pressure is released. Other types of biasing elements, for example, leaf springs, torsion bars or similar devices may be used to bias the handles toward the open position. Alternatively, the exemplary coil springs 20, 22 shown may be mounted upon the guide rods 16, 18 to maintain the coil springs and prevent them from bending. Alternatively, the handles may be joined at one end by a hinge with a biasing element therebetween such that the handles are pivotably connected.

The first handle 12 has a razor blade 26 extending outwardly therefrom. As shown, the razor blade 26 may be removably held in a razor blade holder 24 so that the razor blade 26 can be removed, such as for sharpening and replacement. The razor blade 26 extends substantially the length of the exposed portion of the razor blade holder 24. The razor blade 26 can be arranged perpendicular or at an angle with respect to the hair guiding bar 28 described below.

Figure 2:
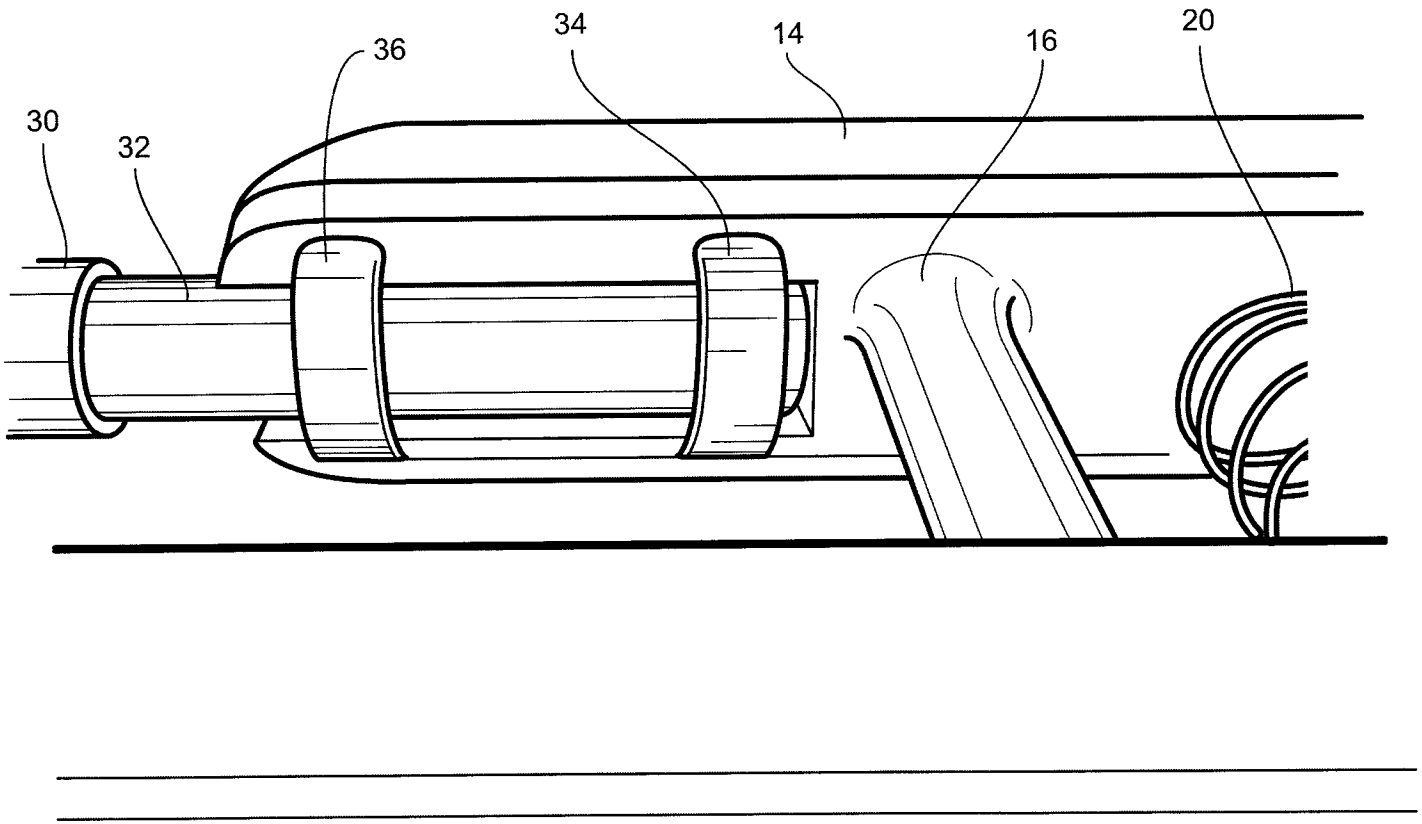
FIG. 2 is an enlarged view showing the bearing arrangement of the hair guiding bar.

The second handle 14 has a hair guiding bar 28 extending outwardly therefrom in the same direction as the razor blade 26, such that the hair guiding bar 28 and the razor blade 26 are in parallel alignment. The blade portion of the razor blade 26 points in the direction of the hair guiding bar 28, and may be arranged substantially perpendicular or at an angle thereto. As shown, the hair guiding bar 28 includes an elongate tube or roller 30 mounted on an elongate core 32, with the core 32 being carried for rotation on a pair of roller bearings 34, 36, or, alternatively, bushings mounted in the handle as shown in FIG. 2. In an alternative embodiment, the hair guiding bar 28 may include a metal bar having a circular or other cross-sectional coated with a relatively low-friction material such as TEFLON®, polished stainless steel, etc. In the alternative embodiment, the hair guiding bar 28 it not required to rotate and the razor is not required to include bearings or bushings. Various combinations of stationary hair guiding bars, rotatable hair guiding bars, rollers, bearings and low-friction coatings/materials are within the scope of this disclosure.

Figure 3:
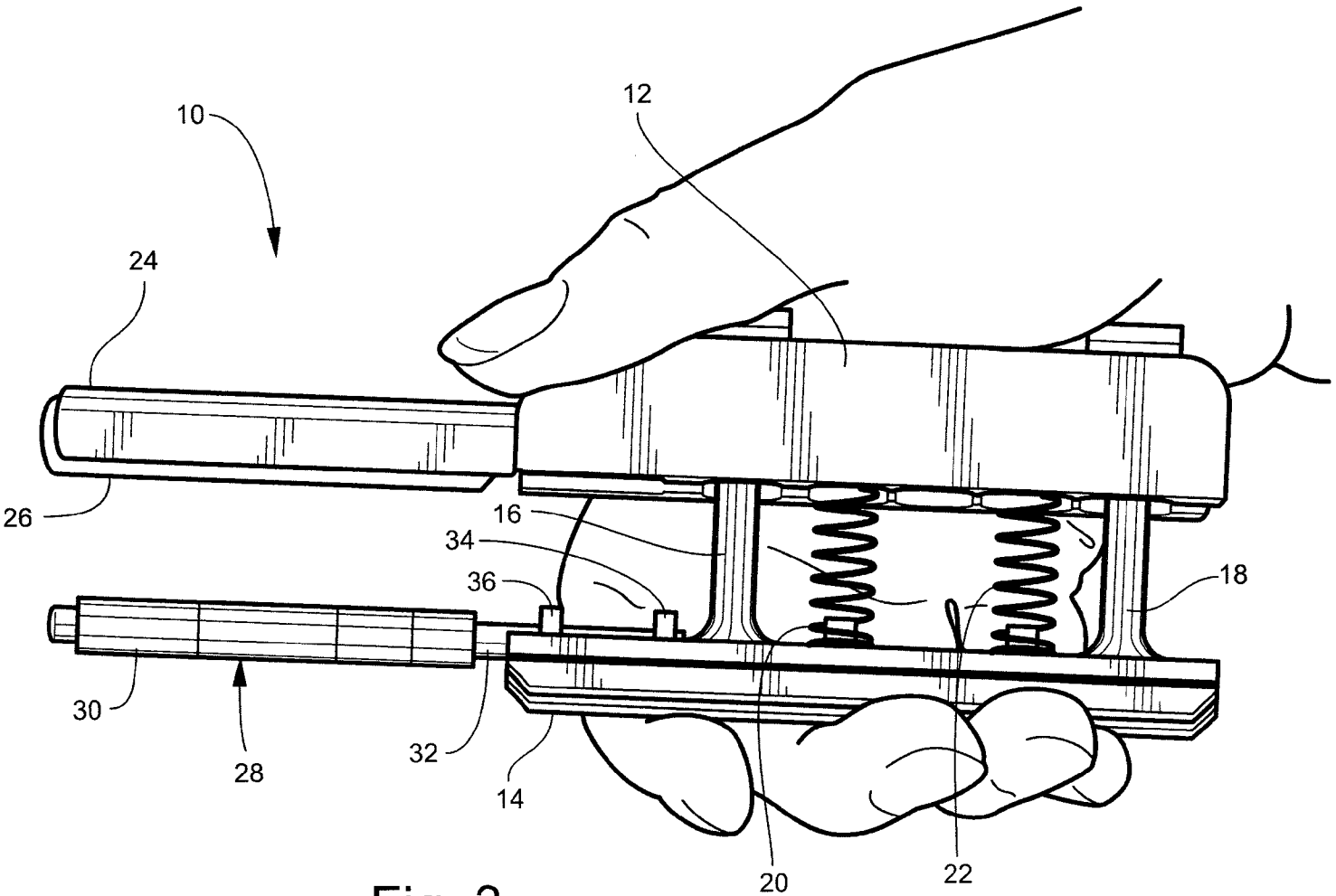
FIG. 3 is a side view of the razor shown in the open position.

Referring to FIG. 3, in the open position, the first and second handles 12, 14 are apart, and consequently the razor blade 26 and the hair guiding bar 28 are spaced-apart such that a section of hair can be positioned therebetween.

Figure 4:
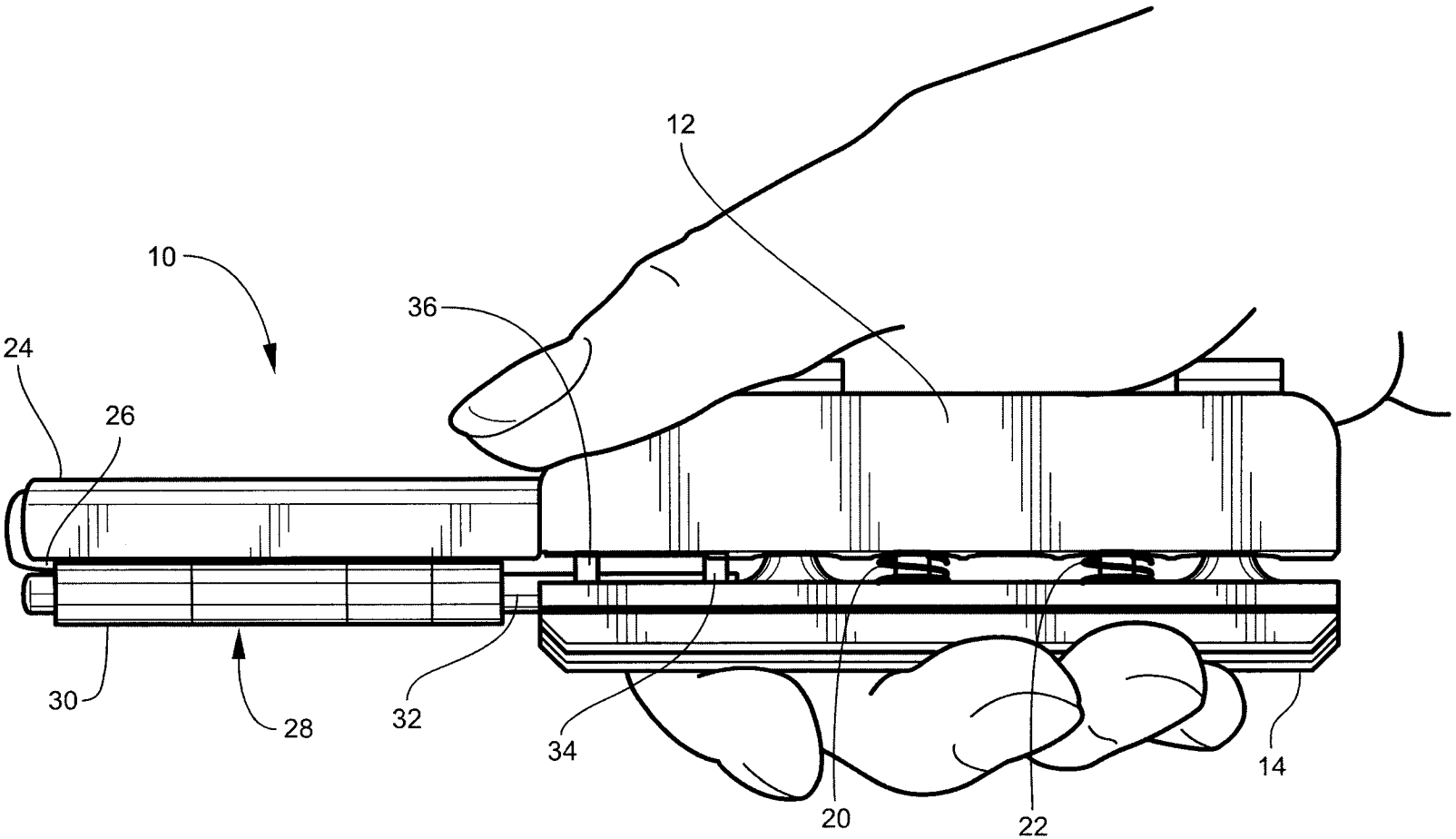
FIG. 4 is a side view of the razor shown in a closed position.

Referring to FIG. 4, in the closed position, the first and second handles 12, 14 are moved together such that the biasing element is compressed and the razor blade 26 and the hair guiding bar 28 are brought together (i.e., toward one another). In one embodiment, the razor blade 26 and the hair guiding bar 28 may engage, either perpendicularly or at an angle. In an alternative embodiment, the razor blade 26 and the hair guiding bar 28 may be slightly spaced-apart in the closed position. The spacing therebetween may be provided by a variable spacer that allows the user to customize the amount of spacing. As shown, the spacing may be provided by the properties of the coil springs 20, 22 and the arrangement of the coil springs with respect to the handles 12, 14. For example, the spacing between the razor blade 26 and the hair guiding bar 28 in the closed position may be controlled by the maximum compression distance of the biasing elements. The razor 10 is preferably constructed so that the razor blade 26 and the hair guiding bar 28 remain parallel throughout their range of movement.

In use, the razor 10 is preferably used in conjunction with a conventional barber comb, with the razor 10 being held and operated in one hand and the comb in the other. As the comb is passed through the hair, a thin section of hair is exposed between the teeth of the comb. With the razor 10 in the open position, the user manipulates the thin section of hair held in place by the comb into the space between the razor blade 26 and the roller 30. The handles 12, 14, are then squeezed together to the closed position, and the wrist is turned slightly to expose the hair to the razor blade 26 at an oblique angle, for example, about 45 degrees. The entire razor 10 is then pulled towards the end of the hairs of the section of hair held by the comb, using the surface of the comb as a support and guide for the razor 10. As this occurs, the hair passes over the roller 30 and is forced against the razor blade 26 at a sharp angle. The hairs are cut at this sharp angle, and as the blade passes along the length of the hairs, the hairs are cut at a slightly different length, creating a desired layering, feathering or thinning. As the user gains experience with the razor 10, different effects can be achieved by manipulating the razor 10 by holding it at differing angles, using different spacings between the roller 30 and razor blade 26, and applying different pressures to the hair as it is cut. The user can carry out the above steps repeatedly, ultimately achieving the desired effect. The razor 10 advantageously enables a relatively inexperienced user to safely and efficiently cut and style hair without being exposed to the fully-exposed blade of a conventional straight razor typically used by barbers and hair stylists.

Although exemplary embodiments of a hair feathering razor are described herein, it is envisioned that various details may be changed without departing from the spirit and scope of this disclosure. Furthermore, the foregoing description of the exemplary embodiments and best mode are provided for the purpose of illustration only and not for the purpose of limitation.

I claim:

1. A hair feathering razor, comprising:

(a) a first handle and a second handle connected and configured to be manually gripped in a user's hand and selectively moved between an open and a closed position by opening and closing the hand, the second handle having at least one post extending therefrom upon which the first handle slides;

(b) a biasing element biasing the first and second handles in the open position;

(c) a single elongate blade extending outwardly from the first handle along a longitudinal axis which is a all times parallel to a longitudinal axis of an elongate hair guiding bar extending outwardly from the second handle, the hair guiding bar having a roller rotatably carried thereon, the roller and the blade being engaged when the handles are in the closed position.

2. The hair feathering razor according to claim 1, wherein the biasing element further comprises a variable spacer for spacing the blade and the hair guiding bar apart in the closed position, the spacing being achieved by a maximum compression distance of the biasing element.

3. The hair feathering razor according to claim 1, wherein the blade is removably secured within a blade holder extending outwardly from the first handle.

4. A hair feathering razor, comprising:

(a) a first handle and a second handle connected and configured to be manually gripped in a user's hand and selectively moved between an open and a closed position by opening and closing the hand;

(b) a biasing element interconnecting the first and second handles for biasing the first handle and the second handle in the open position;

(c) a single elongate blade extending outwardly from the first handle along a longitudinal axis which is at all times parallel to a longitudinal axis of an elongate hair guiding bar extending outwardly from the second handle and having a roller rotatably carried thereon, the roller and the blade being engaged when the handles are in the closed position.

5. The hair feathering razor according to claim 4, wherein the blade and the roller are in parallel alignment and have a substantially same length.

6. The hair feathering razor according to claim 4, wherein the biasing element further comprises a variable spacer for spacing the blade and the hair guiding bar apart in the closed position, the spacing being achieved by a maximum compression distance of the biasing element.

7. The hair feathering razor according to claim 4, wherein the connection between the first and second handles comprises at least one guide rod that, in combination with the biasing element, maintains the first and second handles parallel to one another at all times as the handles are moved between the open and closed positions.

8. The hair feathering razor according to claim 7, wherein the second handle is fixed relative to the at least one guide rod and the first handle is slidable along the at least one guide rod.

9. The hair feathering razor according to claim 4, wherein the blade is removably secured within a blade holder extending outwardly from the first handle.

* * * * *

UNITED STATES PATENT AND TRADEMARK OFFICE

CERTIFICATE OF CORRECTION

PATENT NO. : 8,484,851 B2
APPLICATION NO. : 13/193742
DATED : July 16, 2013
INVENTOR(S) : Joseph Eugene Buchan It is certified that error appears in the above-identified patent and that said Letters Patent is hereby corrected as shown below:

In the Claims:

On column 4, line 54 claim 1 (c) the word before "all times" should be "at" not "a".

Signed and Sealed this
Third Day of September, 2013

Teresa Stanek Rea
*Acting Director of the United States Patent and Trademark Office*